US007913593B2

(12) United States Patent
Dahar et al.

(10) Patent No.: US 7,913,593 B2
(45) Date of Patent: Mar. 29, 2011

(54) INSTALLATION TOOL FOR A THREADED OBJECT

(75) Inventors: Jason A. Dahar, Tucson, AZ (US); Jaime Robledo, Las Cruces, NM (US)

(73) Assignee: Raytheon Company, Waltham, MA (US)

( * ) Notice: Subject to any disclaimer, the term of this patent is extended or adjusted under 35 U.S.C. 154(b) by 165 days.

(21) Appl. No.: 12/206,042

(22) Filed: Sep. 8, 2008

(65) Prior Publication Data

US 2010/0058900 A1 Mar. 11, 2010

(51) Int. Cl.
*B25B 23/10* (2006.01)

(52) U.S. Cl. ..... 81/452; 81/453; 81/454

(58) Field of Classification Search ..... 81/451–458; 606/104

See application file for complete search history.

(56) References Cited

U.S. PATENT DOCUMENTS

| | | | | |
|---|---|---|---|---|
| 881,298 | A * | 3/1908 | Chappel | 81/452 |
| 1,441,956 | A * | 1/1923 | Watson | 81/452 |
| 1,712,196 | A * | 5/1929 | Burger et al. | 81/452 |
| 3,245,446 | A * | 4/1966 | Morifuji | 81/452 |
| 3,373,639 | A * | 3/1968 | Van Dalen et al. | 81/112 |
| 4,744,273 | A * | 5/1988 | Bartok, Jr. | 81/453 |
| 7,069,826 | B2 * | 7/2006 | Tilton | 81/457 |
| 2008/0041196 | A1 * | 2/2008 | Companioni et al. | 81/453 |

* cited by examiner

*Primary Examiner* — D. S Meislin
(74) *Attorney, Agent, or Firm* — Renner, Otto, Boisselle & Sklar, LLP

(57) ABSTRACT

A tool for installing a threaded object includes a bit or inner implement that has a tip for engaging a head of the threaded object, and a sleeve surrounding the inner implement for securing the threaded object to the tool during the installation process. The sleeve includes plural arms at least some of which have inner lips that engage the head of the threaded object to hold the head against the tip. The inner lips are chamfered to facilitate engagement and disengagement between the sleeve and the head of the threaded object. The sleeve is able to translate to a limited extent relative to the inner implement, in order to pull back and disengage from the threaded object head as the threaded object is received into a threaded opening.

23 Claims, 5 Drawing Sheets

INSTALLATION TOOL FOR A THREADED OBJECT

GOVERNMENT RIGHTS

This invention was made with United States Government support under Contract Number N00024-03-C-6111 awarded by the Department of the Navy. The United States Government has certain rights in this invention.

BACKGROUND OF THE INVENTION

1. Technical Field of the Invention

The invention is in the field of tools for installing threaded objects, such as threaded fasteners or explosive bolts.

2. Description of the Related Art

There is a continuing need to be able to install threaded fasteners or other threaded objects, such as explosive bolts, in locations where it can be very difficult to retrieve the threaded objects if they are dropped. Examples of such situations include installation of fasteners in missile bodies and for securing aircraft engines or other parts.

SUMMARY OF THE INVENTION

According to an aspect of the invention, a tool for gripping the head of a threaded object includes a sleeve having arms with lips on their inner surfaces.

According to another aspect of the invention, a tool for gripping the head of a threaded object includes a bit having a tip for engaging the head, and a sleeve surrounding the bit that holds the head against a tip of the bit prior to the threading operation and during at least part of the threading operation.

According to yet another aspect of the invention, a tool for installing a threaded object includes a sleeve that couples the head to a bit that is surrounded by a sleeve, wherein the sleeve automatically disengages from the threaded object during the threading operation.

According to still another aspect of the invention, a tool for gripping and installing a threaded object includes a bit and a sleeve surrounding the bit, wherein the bit and the sleeve are mechanically coupled together and able to translate relative to one another to a limited extent in a direction along a longitudinal axis of the tool. The sleeve and the bit may share the same longitudinal axis.

According to a further aspect of the invention, a tool includes: a bit having a tip for engaging a head of threaded object; and a sleeve surrounding the bit and mechanically coupled to the bit such that the sleeve relative to the bit in a direction parallel to a longitudinal axis of the bit. The sleeve includes multiple arms able to flex radially outward away from the bit. The at least some of the arms have respective lips protruding radially inward along inner surfaces of the at least some of the arms.

According to a still further aspect of the invention, a method of installing a threaded object in a threaded hole includes the steps of: securing the threaded object to a tool that includes a sleeve surrounding an inner implement, wherein the securing includes having a tip of the inner implement engage a head of the threaded object, and wherein the securing includes receiving a head of the threaded object in a socket defined by the sleeve; threading the threaded object into the threaded hole by turning the inner implement with the tip of the inner implement engaged with the head of the threaded object; and disengaging the sleeve from the threaded object as the threaded object is threaded into the threaded hole, wherein the disengaging occurs automatically during threading as the sleeve presses against material surrounding the threaded hole.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A tool for installing a threaded object includes a bit or inner implement that has a tip for engaging a head of the threaded object, and a sleeve surrounding the inner implement for securing the threaded object to the tool during the installation process. The sleeve includes plural arms at least some of which have inner lips that engage the head of the threaded object to hold the head against the tip. The inner lips are chamfered to facilitate engagement and disengagement between the sleeve and the head of the threaded object. The sleeve is able to translate to a limited extent relative to the inner implement, in order to pull back and disengage from the threaded object head as the threaded object is received into a threaded opening.

Figure 1:
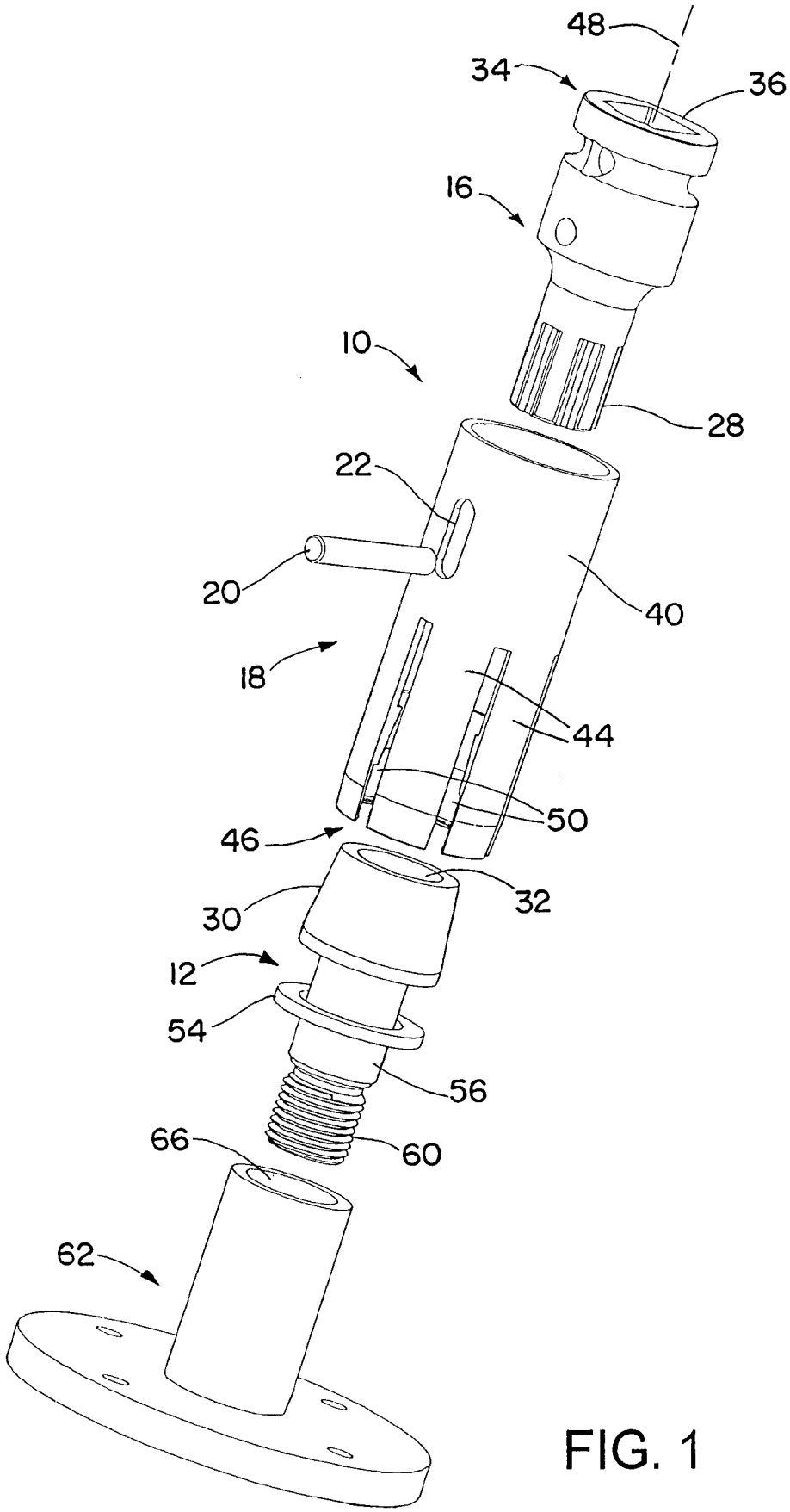
FIG. 1 is an exploded view of a tool in accordance with an embodiment of the present invention, and of a threaded object to be engaged by the tool.

FIG. 1 shows an installation tool 10 that is used for securing and installing a threaded object 12. The threaded object 12 may be an explosive bolt, a threaded fastener, or another type of threaded object. The installation tool 10 includes a bit or inner implement 16, a sleeve socket 18, and a pin 20. When the tool 10 is assembled, the sleeve socket 18 surrounds the bit 16. The pin 20 mechanically couples the bit 16 and the sleeve socket 18 together. The pin 20 passes through an elongate hole 22 in the sleeve 18, and is press fit into a round hole 26 in the bit 16. The bit 16 has a bit tip 28 that is configured to engage a head 30 of the threaded object 12. In the illustrated embodiment the bit tip 28 engages a recess 32 in the threaded object head 30. The bit tip 28 may have any of a variety of shapes, including a hex shape or a TORX or star shape. Alternatively, the bit tip 28 may engage the threaded object head 30 in other ways, such as by engaging outer surfaces of the threaded object head 30. The bit tip 28 may have an engagement mechanism 34 on the end opposite the bit tip 28, for engaging a driver, wrench, or other device, for turning the bit 16. In the illustrated embodiment the engagement mechanism 34 includes a recess 36 that can be secured to another device.

The sleeve socket 18 has a sleeve body 40, and plural sleeve arms 44 that extend longitudinally downward from the sleeve body 40. The sleeve arms 44 define an opening or socket 46 for receiving the threaded object head 30. The sleeve arms 44 may be axisymmetrically located about a common longitudinal axis 48 shared by the bit 16 and the sleeve socket 18. The sleeve arms 44 are separated from one another by gaps or slots 50. This allows the sleeve arms 44 to flex outward, so as to resiliently move outward to engage or disengage the threaded object head 30 and a washer 54 that is located on a shaft 56 of the threaded object 12. The sleeve body 40 and the sleeve arms 44 may be all parts of a single monolithic piece of material that constitutes the sleeve 18. The gaps or slots 50 may correspond to portions of material removed from the sleeve 18 by any of a variety of suitable processes, such as machining.

The elongate hole 22 allows translation of the sleeve 18 relative to the bit or inner implement 16. This translation is in the longitudinal direction of the tool 10 (parallel to the longitudinal axis 48). This relative translation is utilized in the automatic disengagement of the sleeve 18 from the threaded object 12 as the threaded object 12 is installed into an internally-threaded hole.

The threaded object shaft 56 has a threaded end 60. A base 62 is used for receiving portions of the threaded object shaft 56, in a hole 66, in order to facilitate engagement of the installation tool 10 on the head 30 of the threaded object 12.

It will be appreciated that many alternatives are possible regarding the type of engagement between the bit or inner implement 16 and the sleeve socket 18. Suitable lips on the inside of the sleeve body 40 may be used to provide limited relative translation between the sleeve socket 18 and the bit 16, for instance. Other alternatives involve a protrusion either on the bit 16 or the sleeve 18 that engages a recess or slot of limited extent in the other member.

Figure 2:
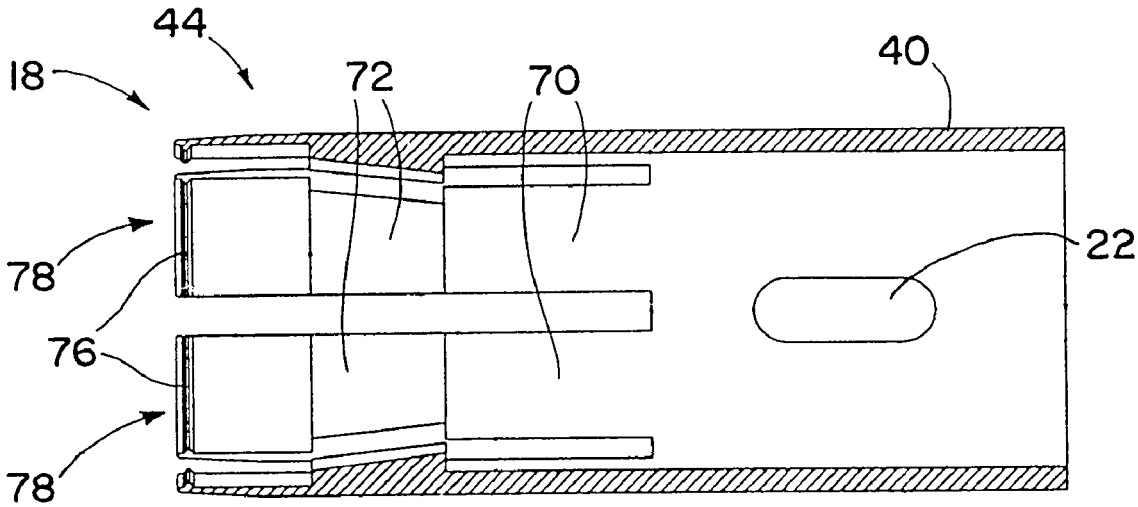
FIG. 2 is a sectional view of a sleeve socket of the tool of FIG. 1.
Figure 3:
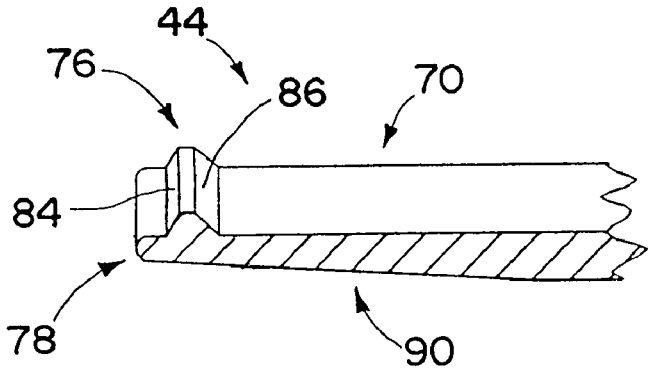
FIG. 3 is a detailed sectional view of the tip or free end region of one of the sleeve arms of the sleeve socket of FIG. 2.

With reference now in addition to FIGS. 2 and 3, further details are now given of structure on the inside surfaces of the sleeve arms 44. Inner arm surfaces 70 have respective sloped sections or stops 72. The sloped sections 72 correspond in shape to the slope on the threaded object head 30. The sloped section 72 may serve as a stop, preventing overinsertion of the head 30, as well as providing better support to the threaded object 12 when the head 30 is engaged with and inside the sleeve 18. It will be appreciated that the stop 72 may have a different shape corresponding to a different shape for the threaded object head 30 (FIG. 1), or may alternatively be omitted altogether.

The arms 44 each have a lip 76 near a free end 78 of the arm 44. The lip 76 is used to engage the head 30 or the washer 54, and mechanically couple together the bit 16 and the threaded object 12. The lip 76 is a protrusion extending radially inward from the arm inner surface 70. The lip 76 has chamfered or sloped surfaces 84 and 86 in both longitudinal directions, both toward the arm free end 78 and away from the arm free end 78. The chamfered or sloped surfaces 84 and 86 aid in engagement and disengagement of the sleeve 18 with the threaded object 12.

The sleeve socket 18 may be made of flexible stainless steel, such as 17-4 stainless steel. Other types of steel may alternatively be used. In addition, other types of materials may be used for the sleeve socket 18, such as aluminum or suitable plastics.

The sleeve arms 44 have a thinned or sloped tip portion 90 in the vicinity of the arm free end 78. This sloped end they make for more flexibility in the parts of the arm 44 that are around the lips 76. The sloped section or stop 72 may also function to provide increased rigidity to the arms 44 in the area of the arms 44 that surrounds the threaded object head 30.

The illustrated embodiment shows the sleeve 18 with six sleeve arms 44. It will be appreciated that a greater or lesser number of sleeve arms may be utilized. In addition, it will be appreciated that a wide variety of configurations of the sleeve arms may be used for engaging different threaded objects having different head configurations. For instance, it will be appreciated that the sleeve arms may be configured for engaging a threaded object having a hexagonal or square shape head. The sleeve arms for such an arrangement may be flat, rather than the curved arms illustrated in FIGS. 1-3. In connection with this it will be appreciated that the sleeve 18 may alternatively have a non-cylindrical cross section.

Figure 4:
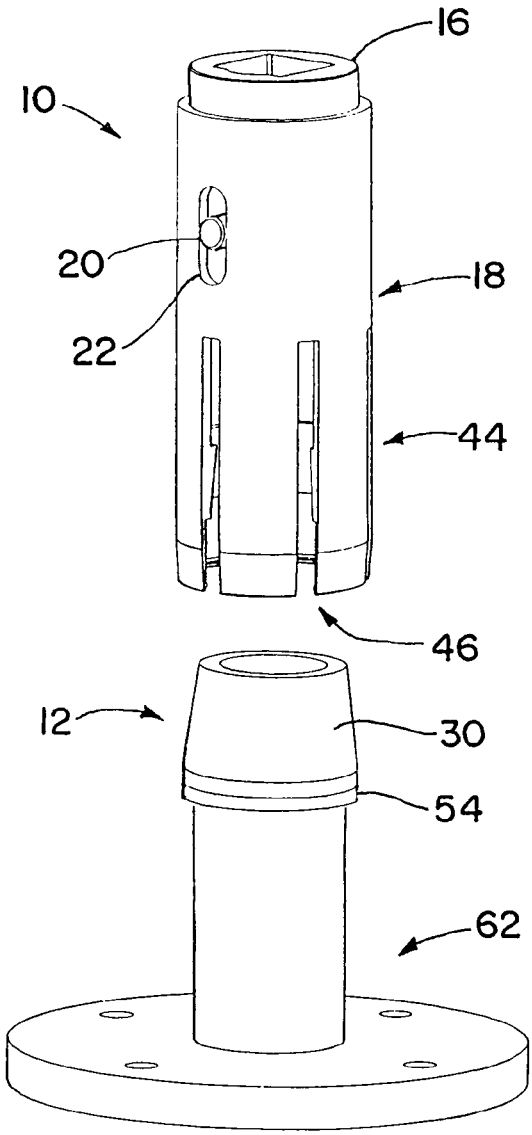
FIG. 4 is an oblique view showing a first step in use of the tool of FIG. 1 to install a threaded object.

FIGS. 4-9 show the process used in installing the threaded object 12 using the tool 10. In FIG. 4 the threaded object 12 is installed in the base 62. The threaded object head 30 and the washer 54 protrude out of the base 62.

Figure 5:
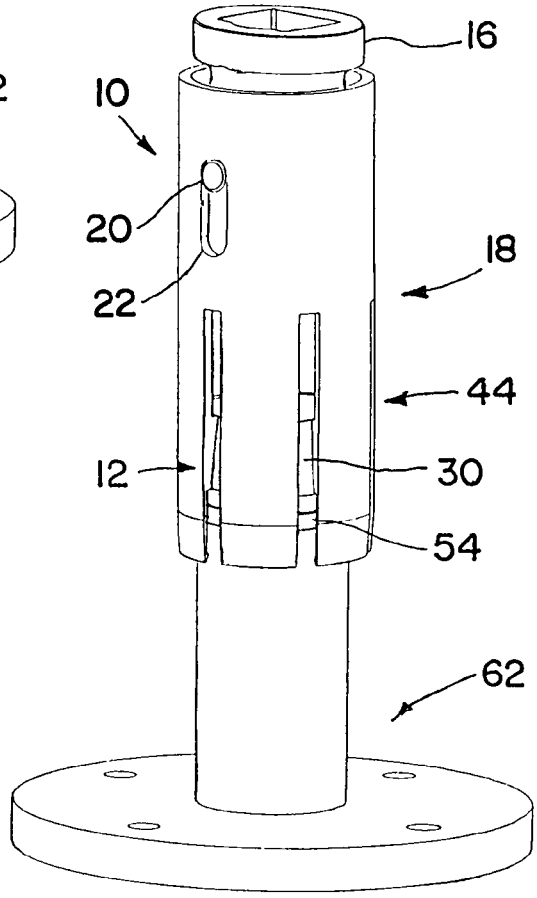
FIG. 5 is an oblique view showing a second step of the installation process.

FIG. 5 illustrates the engagement of the tool 10 with the threaded object 12. The tool 10 is pressed down onto an engagement with the threaded object head 30 (FIG. 1). In doing so the bit tip of the bit or inner implement 16 is engaged with the recess 32 in the threaded object head 30. The sleeve socket 18 is also brought into engagement with the threaded object head 30 and the washer 54, with the head 30 and the washer 54 received in the socket or opening 46. Either before or during the engagement of the bit tip 28 with the threaded object head 30, the sleeve 18 is extended relative to the bit 16. This involves moving the sleeve 18 downward as shown in FIG. 5 until the pin 20 is at the upper most position within the elongate hole 22 (away from the sleeve arms 44). As this is done, and as the bit 16 engages the threaded object head 30, the lips 76 of the sleeve arms 44 come into contact with portions of the threaded object head 30 and the washer 54. This causes the sleeve arms 44 to resiliently deform outward, so as to get around the threaded object head 30 and the washer 54. The chamfered or sloped surfaces 84 that face the free ends 78 of the sleeve arms 44 may aid in urging the sleeve arms 44 radially outward, away from the longitudinal axis 48 of the tool 10. Once the lips 76 move longitudinally beyond the washer 54, the sleeve arms 44 are free to resiliently snap back into place. At this point the threaded object head 30 and the washer 54 are fully within the sleeve 18. The stop 72 may also provide a limit for the travel of the threaded object head 30 into the sleeve socket 18. The presence of the lips 76 on the inner arm surfaces 70 prevents the threaded object head 30 from disengaging from the sleeve 18, unless a sufficient force is provided so as to move the sleeve arms 44 radially outward again.

The elongate hole 22 is positioned and sized relative to the lips 76 such that when the threaded object head 30 and the washer 54 are within the sleeve 18, the bit tip 28 is engaged with the recess 32 in the threaded object head 30. Thus in the engaged position shown in FIG. 5 the threaded object 12 is mechanically coupled to the tool 10, and the bit tip 18 is engaged with the threaded object head 30 so as to be able to transmit torque to the threaded object 12.

Figure 6:
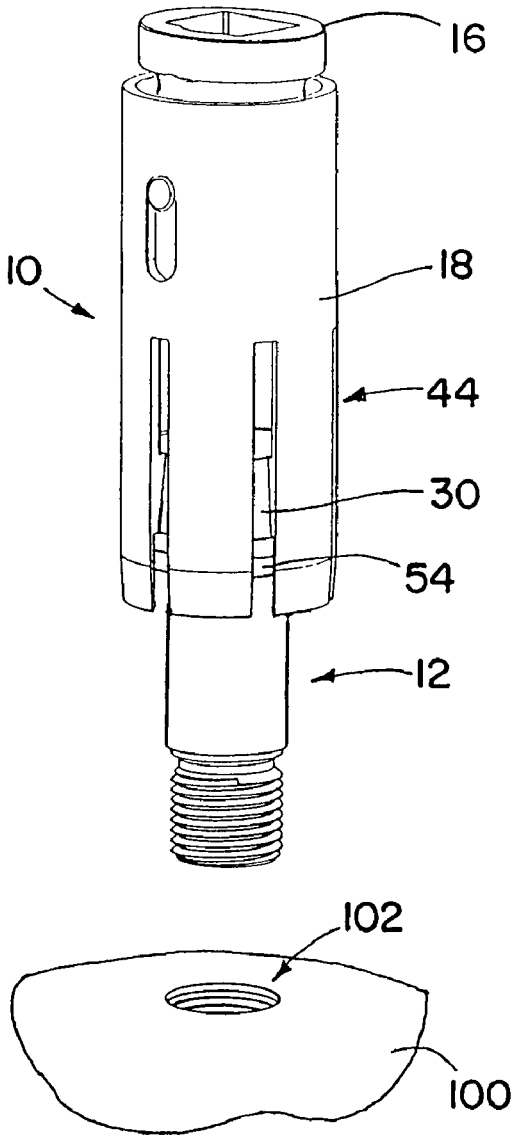
FIG. 6 is an oblique view showing a third step of the installation process.

With the tool 10 and the threaded object 12 coupled together the tool 10 may be used to lift the threaded object 12 out of the base 62, as is shown in FIG. 6. The threaded object 12 and the tool 10 are then moved toward a receiving object 100 having an internally-threaded hole 102 for receiving the threaded object 12. The receiving object 100 may be any of a wide variety of objects that receive a threaded object for fastening or other purposes. It will be appreciated that it is advantageous to have the threaded object 12 mechanically coupled to the tool 10 as the threaded object 12 is brought over to the receiving object 100. As discussed earlier, dropped objects such as explosive bolts or threaded fasteners may cause appreciable delay and expense, due to their need to be removed from sensitive areas.

Figure 7:
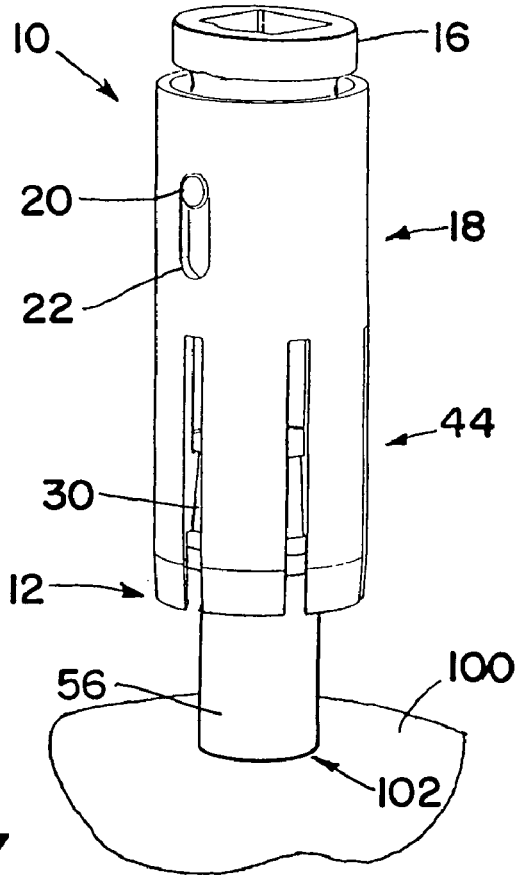
FIG. 7 is an oblique view showing a fourth step of the installation process.

FIG. 7 shows the threaded object 12 partially threaded into the threaded hole 102 in the receiving object 100. Throughout most of the threading operation the threaded object head 30 remains coupled to the sleeve 18. Since the mechanical coupling between the sleeve 18 and the threaded object 12 also maintains the bit tip 28 engaged in the threaded object head 30, there is no need for separate engagement of the bit 16 and the threaded object 12. Simple turning of the installation tool 10 is sufficient to assure turning of the threaded object 12.

Figure 8:
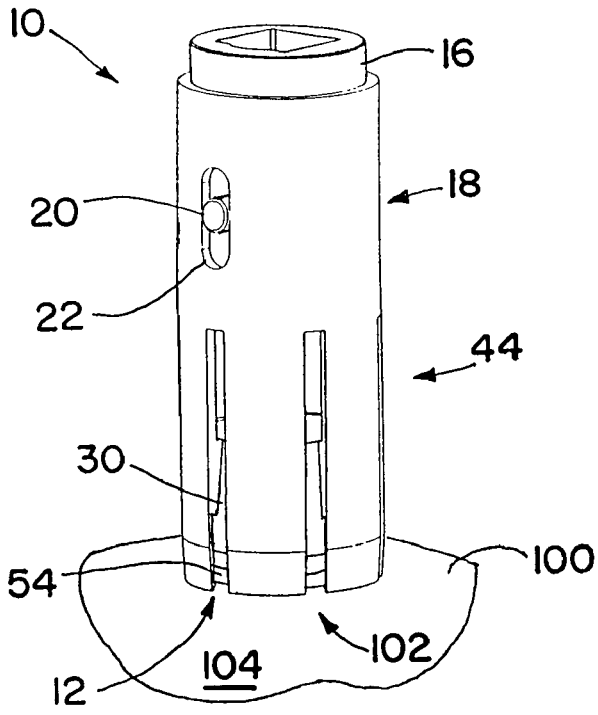
FIG. 8 is an oblique view showing a fifth step of the installation process.

As the threading operation nears its conclusion the sleeve socket 18 and the sleeve arms 44 come into contact with a surface 104 of the receiving object 100, as illustrated in FIG. 8. The free ends 78 of the sleeve arms 44 make contact with the receiving object surface 104. This causes the sleeve 18 to translate laterally upward relative to the bit or inner implement 16. In addition the chamfered or sloped surfaces 86 of the lip 76 come in contact with the washer 54. (If the washer 54 was not present then the chamfered surface 84 would come into contact with the threaded object head 30.) The contact between the sloped lip surfaces 84 and the washer 54 causes the sleeve arms 44 to be pushed radially outward. The sleeve arms 44 resiliently deform radially outward so as to be able to get around the washer 54 and the threaded object head 30, which have a diameter that is larger than the space between the lips 76 of opposite of the sleeve arms 44. As the threaded object 12 continues to be screwed into the threaded hole 102 the sleeve 18 automatically becomes disengaged from the threaded object 12. Since the threaded object 12 is almost completely threaded into the threaded hole 102 at this point this disengagement is of no concern from the standpoint of the possibility of the threaded object 12 becoming loose or dropping into inaccessible areas. It will be appreciated that it is advantageous that the sleeve 18 automatically disengages itself from the threaded object head 30 as part of the process of screwing the threaded object 12 into the threaded hole 102.

Figure 9:
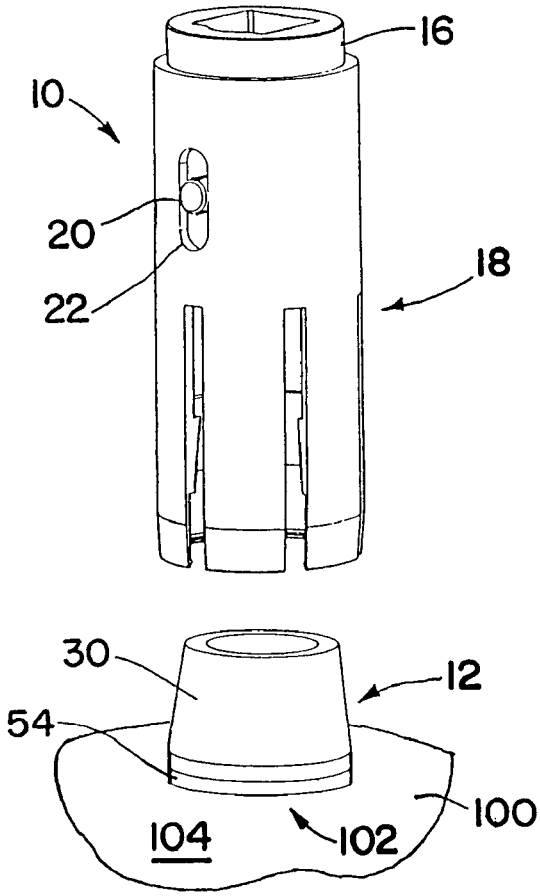
FIG. 9 is an oblique view showing a sixth step of the installation process.

FIG. 9 shows the situation at the completion of the threading process. With the tool 10 automatically mechanically disengaged from the threaded object 12, the tool 10 may be merely lifted off of the threaded object 12. The threaded object 12 has now been fully installed into the receiving object 100, with the threaded object 12 being secured against dropping at all times during the installation process.

The sleeve socket 18 may be configured for engaging only one particular type of threaded object 12. The bit 16 may be permanently coupled to the sleeve 18, though still allowing relative movement between the two. Alternatively, different types of bits and different configurations of sleeves may be utilized in a mix-and-match manner in order to produce tools capable of coupling with different types of threaded objects, for instance having different head configurations and/or requiring different types of engaging bit tips.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A tool comprising:

a bit having a tip for engaging a head of a threaded object; and a sleeve surrounding the bit and mechanically coupled to the bit such that the entire sleeve moves relative to the bit in a direction parallel to a longitudinal axis of the bit and away from the threaded object, as the sleeve disengages from the threaded object as the threaded object is installed;

wherein the sleeve includes multiple arms able to flex radially outward away from the bit;

wherein at least some of the arms have respective lips protruding radially inward along inner surfaces of the at least some of the arms;

wherein the arms extend from a sleeve body of the sleeve, substantially parallel to the longitudinal axis;

wherein the arms and the sleeve body are monolithic parts of a single piece of material;

wherein the sleeve has a substantially circular outer surface;

wherein the outer surface slopes radially inward at a sloped tip portion for each of the arms, in the vicinity of arm free ends of the arms; and wherein for the at least some of the arms the sloped tip portion longitudinally overlaps the lip that protrudes radially inward.

2. The tool of claim 1, wherein the arms define a socket for receiving the head of the threaded fastener.

3. The tool of claim 2, wherein the inner surfaces of the at least some of the arms each have both a sloped surface that corresponds in shape the threaded fastener head, and a circumferential surface at a substantially constant distance from the longitudinal axis, the circumferential surface being longitudinally between the lip and the sloped surface.

4. The tool of claim 1, wherein the arms are substantially axisymmetric around the longitudinal axis.

5. The tool of claim 1, wherein the lips each have chamfers on them facing a first longitudinal direction away from free ends of the arms; and wherein the lips also each have additional chamfers on them facing a second longitudinal direction, opposite from the first direction, toward free ends of the arms.

6. The tool of claim 1, wherein the tip is a male tip configured to for insertion into one or more corresponding recesses in a head of a threaded object.

7. The tool of claim 1, further comprising a pin that is located in openings in both the bit and the sleeve.

8. The tool of claim 7, wherein at least one of the openings has a length in a longitudinal direction greater than an extent of the pin in the longitudinal direction, thereby allowing the pin to translate in a longitudinal direction within the at least one of the openings.

9. The tool of claim 8, wherein the length in the longitudinal direction is at least twice the extent of the pin in the longitudinal direction.

10. The tool of claim 7, wherein one of the openings is a closed elongate slot in the sleeve.

11. The tool of claim 7, wherein the pin is press-fit in the bit.

12. The tool of claim 7, wherein the bit has an engagement mechanism, on an end opposite the tip, for engaging a device for turning the bit.

13. The tool of claim 1, wherein the arms include at least six arms.

14. The tool of claim 1, wherein one or more of the arms have respective stops that prevent overinsertion of the head; and wherein the stops are sloped portions of the one or more arms.

15. The tool of claim 14, in combination with the threaded object;

wherein the stops corresponding in shape to a sloped surface of the head.

16. The tool of claim 1, wherein the bit has an engagement mechanism, on an end opposite the tip, for engaging a device for turning the bit.

17. A method of installing a threaded object in a threaded hole, the method comprising:

securing the threaded object to a tool that includes a sleeve surrounding an inner implement, wherein the sleeve has a sleeve body and arms that extend from the sleeve body, substantially parallel to a longitudinal axis of the inner implement, wherein the sleeve body and the arms are monolithic parts of a single piece of material, wherein the securing includes having a tip of the inner implement engage a head of the threaded object, and wherein the securing includes receiving the head of the threaded object in a socket defined by the sleeve;

threading the threaded object into the threaded hole by turning the inner implement with the tip of the inner implement engaged with the head of the threaded object; and disengaging the sleeve from the threaded object as the threaded object is threaded into the threaded hole, wherein the disengaging occurs automatically during threading as the sleeve presses against material surrounding the threaded hole;

wherein the disengaging includes moving the entire sleeve relative to the inner implement in substantially parallel to the longitudinal axis of the inner implement and away from the threaded object;

wherein at least some of the arms have radially-inward-protruding lips;

wherein the sleeve has a substantially circular outer surface;

wherein the outer surface slopes radially inward at a sloped tip portion for each of the arms, in the vicinity of arm free ends of the arms;

wherein for the at least some of the arms the sloped tip portion longitudinally overlaps the lip that protrudes radially inward; and wherein the securing includes the sloped tip portions flexing radially outward.

18. The method of claim 17, wherein the disengaging also includes moving the arms radially outward as free ends of the arms press against the material surrounding the threaded hole.

19. The method of claim 17, wherein the arms have lips on their inner surfaces; and wherein the engaging includes engaging the head of the threaded object with the lips to hold the head in the socket.

20. The method of claim 19, wherein the engaging includes moving the arms radially outward as the head is received into the socket.

21. The method of claim 20, wherein the lips have chamfers on the lips that face toward a shaft of the threaded object; and wherein the chamfers that face toward the shaft are pressed against during the moving the arms radially outward during the engaging.

22. The method of claim 19, wherein the disengaging includes moving the arms radially outward as free ends of the arms press against the material surrounding the threaded hole; and wherein the moving includes pressing the head against chamfers on the lips that face away from the threaded hole, to thereby resiliently bend the arms radially outward.

23. The method of claim 17, wherein the disengaging includes moving the sleeve in a longitudinal direction relative to the inner implement.

* * * * *